US005282340A

United States Patent [19]

Cline et al.

[11] Patent Number: 5,282,340

[45] Date of Patent: Feb. 1, 1994

[54] SNOW BRAKE

[75] Inventors: Roger M. Cline, Bluemont; Lawrence W. Boehly, Vienna, both of Va.

[73] Assignee: Real Tool, Inc., Bluemont, Va.

[21] Appl. No.: 879,269

[22] Filed: May 7, 1992

Related U.S. Application Data

[63] Continuation-in-part of Ser. No. 804,913, Dec. 11, 1991, abandoned.

[51] Int. Cl.[5] ..... E04D 13/10

[52] U.S. Cl. ..... 52/24; 52/26

[58] Field of Search ..... 52/24≧26

[56] References Cited

U.S. PATENT DOCUMENTS

| | | | |
|---|---|---|---|
| D. 254,051 | 1/1980 | Zaleski . | |
| 507,776 | 10/1893 | Berger et al. . | |
| 30,788 | 5/1899 | Clark | 52/24 |
| 884,850 | 4/1908 | Peter . | |
| 1,330,309 | 2/1920 | Dixon . | |
| 1,463,065 | 7/1923 | Sleger | 52/24 |
| 1,863,561 | 6/1932 | Brinker et al. . | |
| 4,141,182 | 2/1979 | McMullen . | |
| 5,044,130 | 9/1991 | Chiddister . | |

FOREIGN PATENT DOCUMENTS

| | | | |
|---|---|---|---|
| 0223795 | 3/1962 | Austria | 52/24 |
| 3716491 | 12/1988 | Fed. Rep. of Germany | 52/24 |
| 3723020 | 1/1989 | Fed. Rep. of Germany | 52/24 |

*Primary Examiner*—Carl D. Friedman
*Assistant Examiner*—Robert Canfield
*Attorney, Agent, or Firm*—James Creighton Wray

[57] ABSTRACT

A snow brake has three major portions, all of which are formed together in a single mold by casting. The first part is a gripper base having a rectangular U-shaped cross-section and an elongated side elevation. A slit extends upward from a bottom of the base to receive a roof seam. Set screw openings extend inward from one side wall and to the slit. Indentations are formed in the side opposite the set screw openings, so that the set screws may press portions of the seam into pockets formed by the indentations, deforming the seam and locking the base to the seam of a standing seam metal roof. The snow retainer is a curved plate which is inclined to the base at about a 60° angle. The plate is wide at the curved bottom and is curved inward toward the top. Thick side walls of the base provide rigidity of the entire structure and use the force of the blade for preventing separation of the sides of the base when forcing the set screws inward to deflect the seam into the indentations to anchor the base on a roof seam.

13 Claims, 4 Drawing Sheets

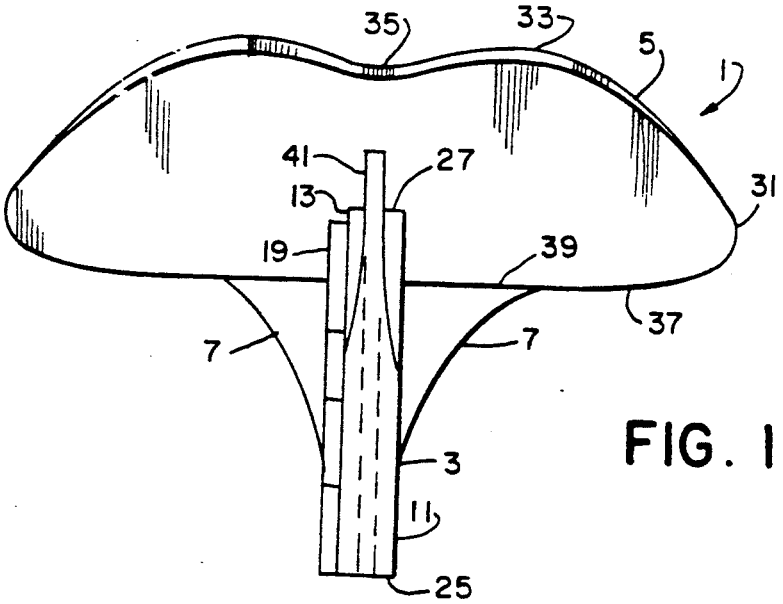
FIG. 1
FIG. 2
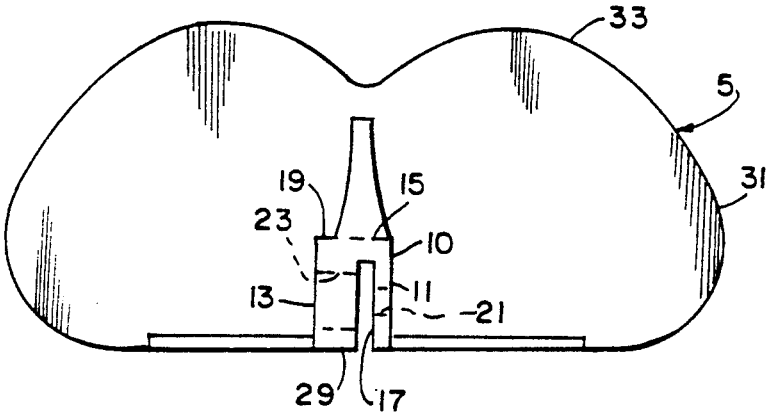
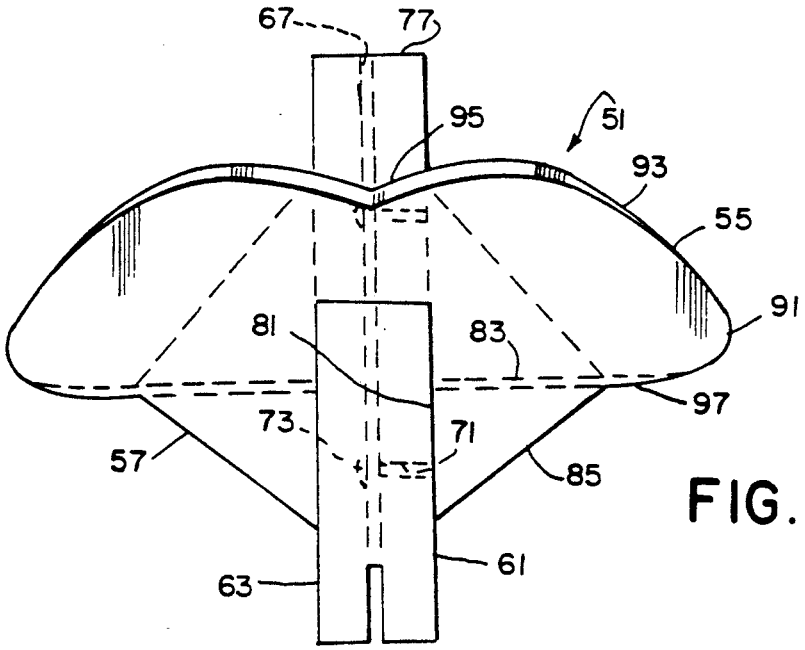
FIG. 7

SNOW BRAKE

This application is a continuation-in-part of application Ser. No. 804,913 filed Dec. 11, 1991, now abandoned.

BACKGROUND OF THE INVENTION

Snow brakes are used for preventing large sheets of ice or snow from sliding and falling from roofs, harming persons or objects below.

Typically, snow accumulates on a roof. The snow may melt from above by warmth from the sun, or from below by warmth from the roof. Water flows through the snow and runs along the roof and drips off edges of the roof.

Particularly on standing seam metal roofs, the water makes the roof surface slick, causing heavy sheets of snow or ice to slide along the roof. Snow brakes are used so that the snow bank or ice sheets formed on the roof are retained until they melt or slide off the roof in small pieces.

Snow brakes have been designed for attaching to the flat surface of the roof, and some snow brakes have been designed for attaching to roof seams.

Multipart snow brakes are expensive. Snow brakes which attached to the flat surface of the roof make holes through the roof and promote water entry and destruction of the roof and its supporting surface. Snow brakes which attach to the seams of roofs penetrate the seams or tend to deform the attachment parts of the snow brakes rather than deform the seams for locking the snow brakes on the roof.

A need exists for snow brakes which may be easily and inexpensively constructed, and which provide adequate support for snow and adequate locking to seams.

SUMMARY OF THE INVENTION

The present invention provides a lightweight, reinforced, one-piece snow brake for attachment to standing seams on metal roofs. The present invention uses the transversely-oriented snow plate in a truss to support the mounting base against spreading, when deforming the seam to lock the snow brake to the standing seam. The same truss structure which prevents spreading of the base by employing the transverse strength of the snow plate also protects the snow plate against bending and breaking by the force of the snow and ice.

The mounting base is uniquely constructed to promote the precise deformation without penetration of the standing seam for locking the standing seam in the snow brake. An upward-extending rib from the base supports a center of the snow plate.

The snow brake has three major portions, all of which are formed together in a single mold by casting. The first part is a gripper base having a rectangular cross-section and an elongated side elevation. A slit extends upward from the base to receive a roof seam. Set screw openings extend inward from one side wall and to the slit. Indentations are formed in the slit opposite the set screw openings, so that the set screws may press the seam into pockets formed by the indentations, deforming the seam and locking the base to the seam of a double standing seam metal roof. The actual snow retainer is a curved plate which is inclined to the base at about a 60° angle. The plate is wide at the bottom and is curved inward toward the top. Generally triangular gussets extend outward from the base to lower portions of the blade to provide rigidity of the entire structure and to use the force of the blade in preventing separation of the sides of the base when forcing the set screws inward to deflect the seam into the indentations to anchor the base on the roof seams.

The snow brake of the present invention has a base with a bottom and a top. The base has a longitudinally extending body with first and second longitudinal ends. A slot extends upward from the bottom toward the top and terminates spaced from the top and extends through the first and second ends for receiving a folded seam of a metal roof in the slot. The slot divides the base into first and second sides connected at the top. One side has holes extending transversely through the side for receiving and holding anchor screws. The other side has recesses aligned with the screw-receiving holes for receiving outward bent portions of the roof seams in the recesses. A snow brake plate is connected to the base and extends laterally beyond opposite sides of the base and extends upward from the bottom to beyond the top of the base. Lateral supports extend outward from sides of the base near the bottom of the base and are connected to laterally extended portions of the snow brake plate near a bottom of the plate. The sides of the base and the bottom portions of the plates are connected to the lateral supports, which are constructed for providing resistance against separation of the sides when tightening anchor screws for bending and locking roof seam portions in the recesses An upper extension extends from a portion of a top of the base to a mid-portion of the snow brake plate for rigidifying the plate.

The lateral supports are generally flat plates with a generally triangular plan form. Preferred lateral support flat plates have generally curved outer edge surfaces.

In one embodiment, a snow brake has an inverted U-shaped base having a central slot for receiving a folded seam of a metal roof. First and second sides extend along the slot, and a top interconnects the sides. The first side has screw-receiving openings for receiving seam-engaging screws, and the second side has enlarged recesses for receiving deformations in the seams caused by the screws. A snow plate extends upward at an angle from one longitudinal end of the base, and has a bottom portions extending laterally beyond the bottoms of the sides of the base. First and second lateral support plates are connected between bottom portions of the snow plate and bottom portions of the first and second sides for supporting the sides with the snow plate and lateral support plates and preventing relative outward movement of the sides when deforming the roof seams with the screws. In one embodiment, the second side is relatively thick as compared with the first side.

An upper extension extends upwardly from the top and engages a central portion of the snow plate for supporting the snow plate.

These and further and other objects and features of the invention are apparent in the disclosure, which includes the above and ongoing written specification, with the claims and the drawings.

BRIEF DESCRIPTION OF THE DRAWINGS

FIG. 1 is a top plan view of one embodiment of the invention.

FIG. 2 is a front elevation of the embodiment shown in FIG. 1.

FIG. 7 is a top plan of the alternate snow brake shown in FIG. 6.

DETAILED DESCRIPTION OF THE DRAWINGS

Figure 3:
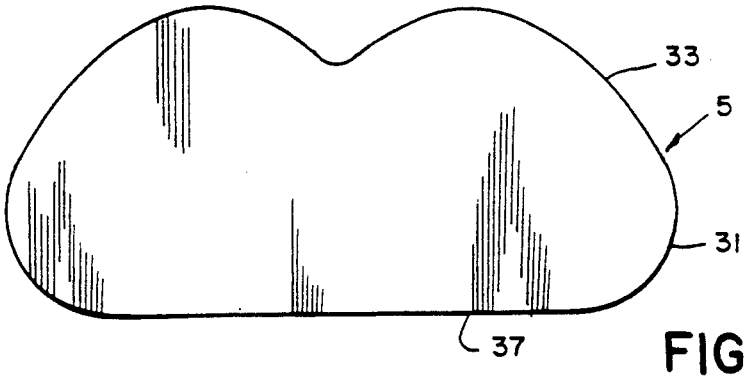
FIG. 3 is a rear elevation showing the snow plate face.
Figure 4:
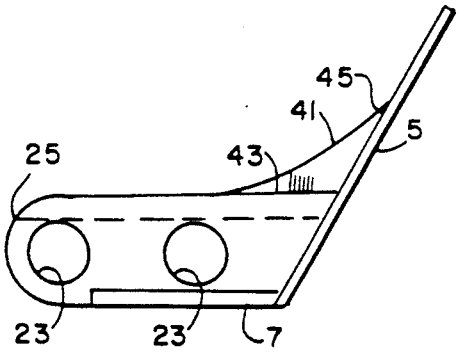
FIG. 4 is a right side elevation of the snow brake shown in FIGS. 1-3.
Figure 5:
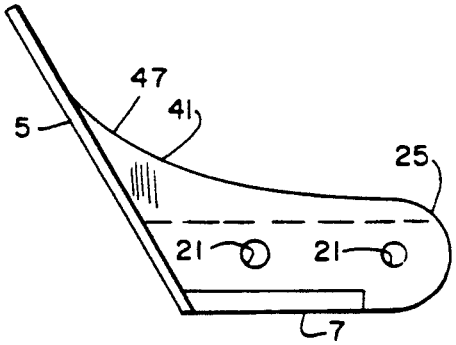
FIG. 5 is a left side elevation of the snow brake shown in FIGS. 1-4.

Referring to FIGS. 1-5, a snow brake is generally indicated by the numeral 1. The snow brake has three elements, a base 3, a curved snow and ice retainer plate 5, and generally triangular gussets 7, which use the strength of the snow plate 5 to support sides of the base 3 against spreading, and which support the snow plate against bending or breaking.

As shown in FIG. 2, the base 3 has a generally U-shaped structure 10 with first and second sides 11 and 13 and a top 15 surrounding an upward-extending slot 17, which receives the standing seam of a roof. Side 13 is reinforced with an extra extension 19. Screw-receiving holes 21 extend through side 11. Holes extend through side 13, forming relatively large receivers 23 for receiving deformed portions of the seam, which are bent outward by pressure of the screws in holes 21. The screws extending into the seam and the deformed portions of the seam extending into the receivers 23 lock the snow brake on the roof seam. The base has a first rounded end 25 and a second sloped, longitudinal end 27 on which the snow plate 5 is integrally formed.

Plate 5 has a lower portion which is aligned with the bottom 29 of the base, and the plate extends outward and upward substantial distances to hold snow. The snow plate 5 has curved outer surfaces 31 and curved upper surfaces 33 with a central depression 35. The snow plate 5 has a bottom 37, which is aligned with the bottom 29 of the mounting base. Generally triangular gussets 7 are formed in one piece with bottom portions of the sides 11 and 13 of the mounting base 3, and with lower central portions 39 of the bottom 37 of the snow blade. The gussets 7 transfer force from the bottom portions of the sides 11 and 13 to the transversely-oriented snow plate 5, to prevent spreading of the bottom portions as screws are inserted in the openings 21 to bend and deform portions of the roof seams into recesses 23 in the opposite base side 13. The gussets 7 rigidify the structure when the structure is locked to the standing roof seams. The gussets 7 also support the bottom portions 39 of the snow plates 5 to prevent bending or breaking of the snow plates due to snow and ice loading.

An upper extension 41 has a relatively wide base 43 formed on an upper surface of the top 15 of the U-shaped base 3. The upper extension 41 forms a buttress and has an edge 45 integrally formed with a middle portion of the plate. An outer edge 47 of the upper extension buttress 41 is uniformly curved. The buttress 41 supports the plate against breaking and bending and transfers forces from the snow plate 5 to the base 3.

The reinforced addition 19 to side 13 reinforces the receivers 23 to allow deformed portions of the roof seam to be forced into the receivers without bending the receivers. The end 25 of the base 3 is rounded.

Figure 6:
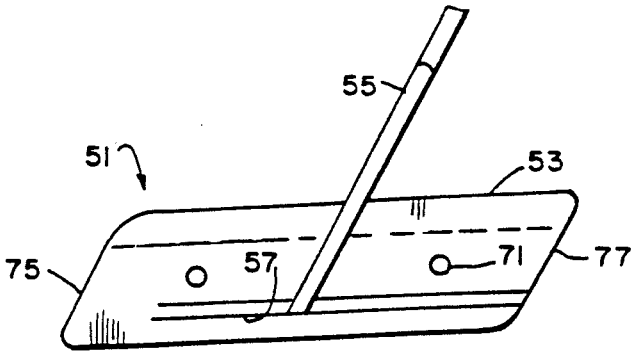
FIG. 6 is a side elevation of an alternate snow brake.
Figure 8:
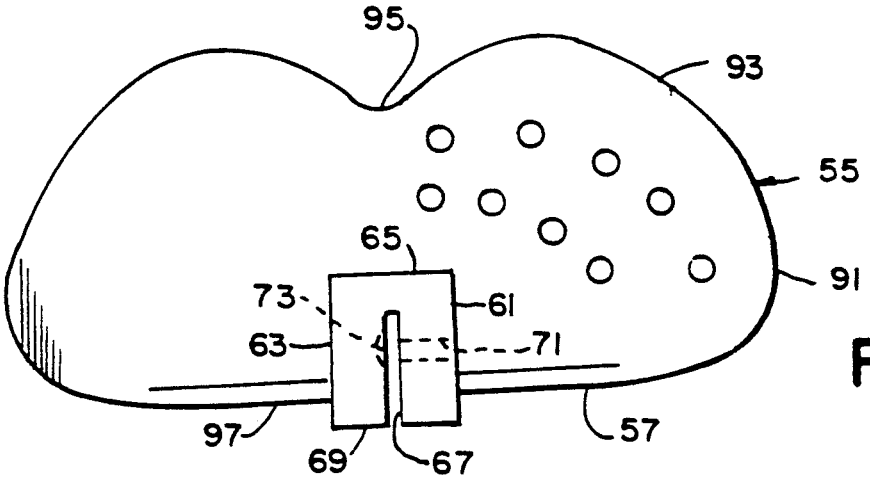
FIG. 8 is a front elevation of the snow brake embodiment shown in FIGS. 6 and 7.
Figure 9:
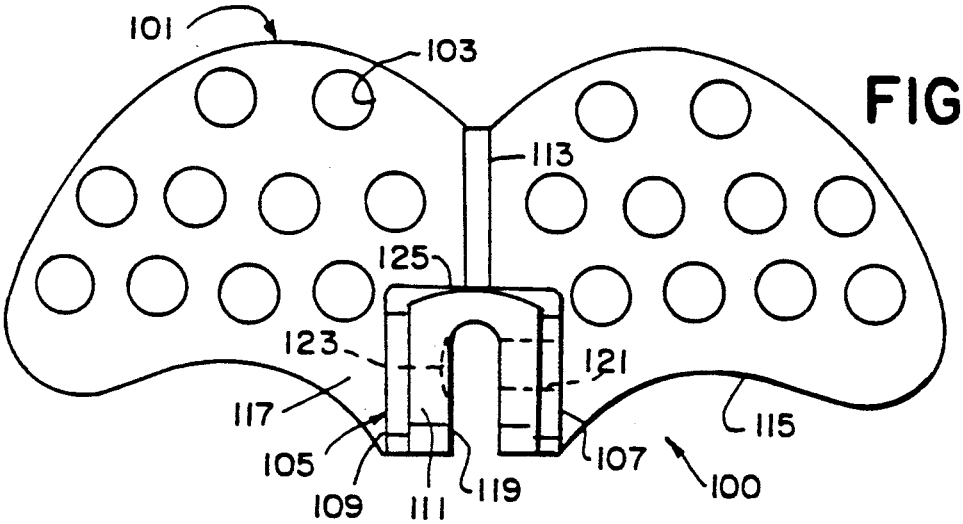
FIG. 9 is a front view of the preferred embodiment of the invention.
Figure 10:
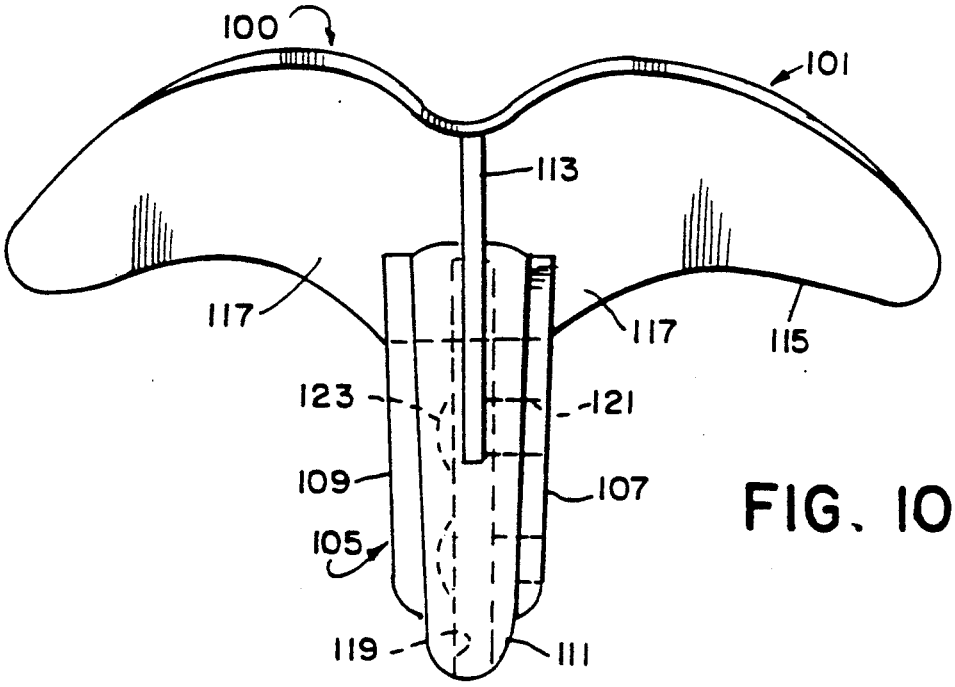
FIG. 10 is a plan view of the preferred embodiment shown in FIG. 9.
Figure 11:
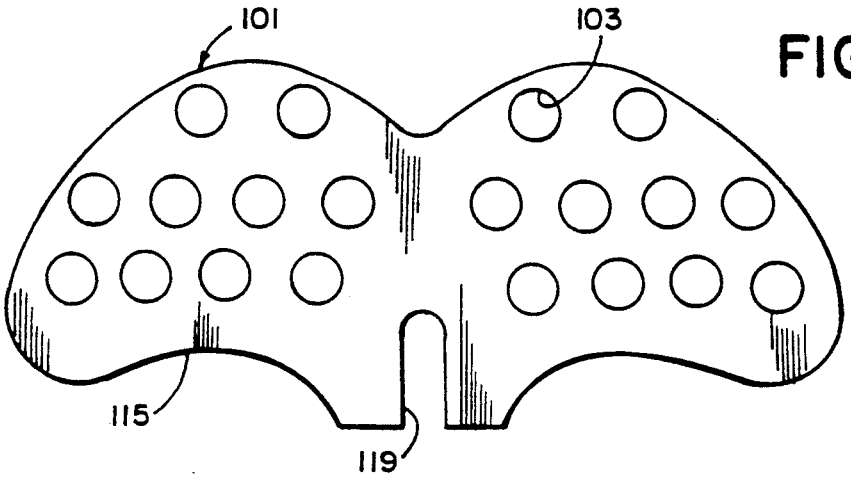
FIG. 11 is a rear view of the embodiment shown in FIGS. 9 and 10.
Figure 12:
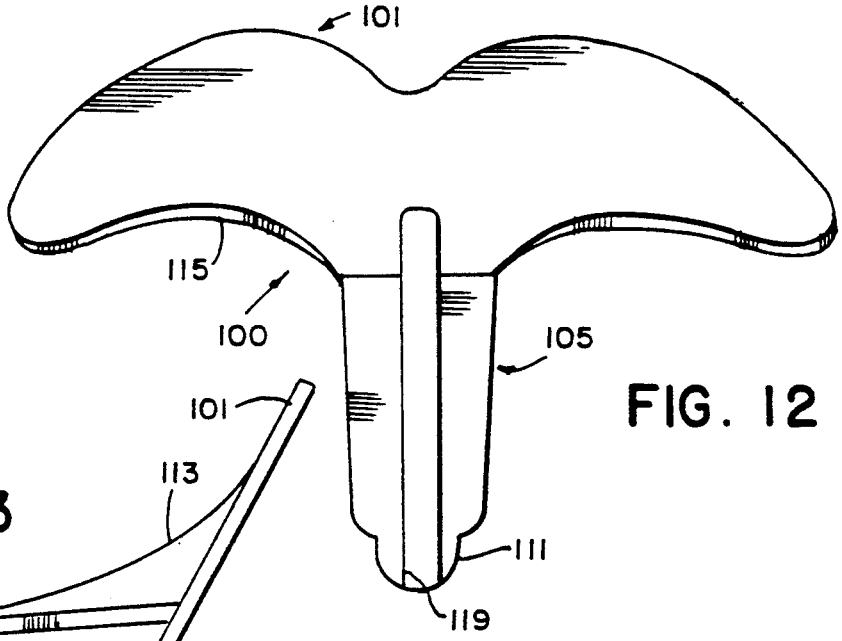
FIG. 12 is a bottom view of the embodiment shown in FIGS. 9-11.

In an alternate form of the invention, generally indicated by the numeral 51 in FIGS. 6, 7 and 8, the mounting base 53 has the form of a parallelogram with a U-shaped cross-section. Plate 55 is formed at a center of the base 53. Four gussets 57 support the sides of the plate against outward movement while installing the deforming screws by transferring a force which would tend to separate the sides to the plate 55.

As shown in FIG. 8, the base 53 has an inverted U-shaped cross-section with sides 61 and 63 joined by a top 65. A thin central slot 67 receives a roof seam, and the bottom 69 of the base rests against a roof. Opening 71 receives a set screw and deforms a portion of the roof seam into a recess 73 in an opposite side 63.

First and second ends 75 and 77 have slopes which are similar to the slope of the plate 55 with respect to the base 53. Gussets 57 have inner edges 81 which are formed with sides of the base beneath the screw-receiving openings 71. Edges 83 of the gussets 57 are integrally formed with the snow blade 55 near lower portions thereof. The outer edge 85 is substantially straight, forming truss-like triangles which support sides 61 and 63 from spreading when sufficient force is supplied by the screw in hole 71 to deform the seam into the recess 73. The triangular, truss-like gussets 57 have a dual function of supporting the thin snow blade against bending or breaking. The snow blades 55 have curved outer edges 91 and curved upper edges 93 leading to a central depression 95. Straight bottom edges 97 are spaced upward from the bottom 69 of the inverted U-shaped base 53. Holes 99 are provided in the snow plate 55 to reduce weight and to allow snow melt or snow particles to pass through the plate 55.

The snow brakes are cast from aluminum, cast iron or bronze. The bases, snow plates and gussets are integrally formed in single castings. The gussets on downward extensions of the blade keep the sides of the base from spreading when tightening the screws to form the permanent mountings of the snow brakes. The gussets also support and sustain the relatively wide snow plates.

Figure 13:
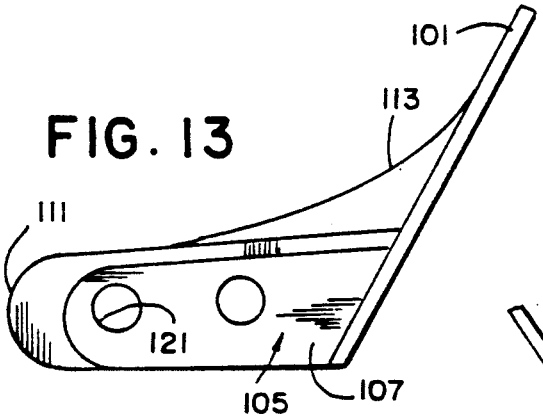
FIG. 13 is a right side view of the embodiment shown in FIGS. 9-12.
Figure 14:
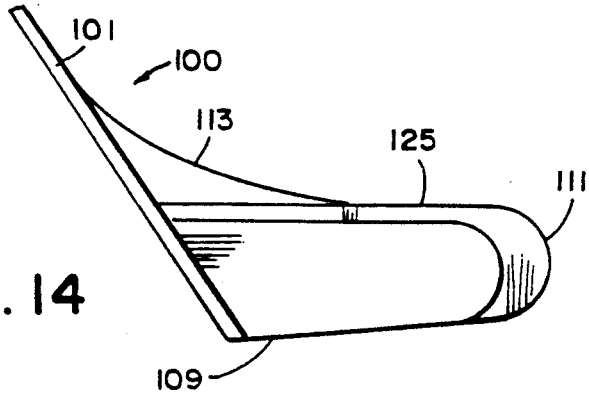
FIG. 14 is a left side view of the embodiment shown in FIGS. 9-13.

A preferred embodiment as shown in FIGS. 9-14 is generally indicated by the numeral 100. The preferred embodiment includes a blade 101 with holes 103 arranged in patterns across the blade, and a base 105 which supports the blade. The base has relatively thick side walls 107 and 109, and a thinner nose portion 111 which projects forwardly. A ridge 113 curves downward toward the base forming a triangular support, as best shown in FIGS. 13 and 14. The blade has a curved lower wall 115 with generally triangular shaped sections 117, which join with the rear of the side walls 107 and 109 of the base, rigidifying the structure.

The holes 103 are arranged in patterns of four, four and two, or ten holes on each side of the blade 101. The base has a central opening 119 which receives a ridge formed by upwardly folded seams of adjacent sections of a flat metal roof.

Holes 121 extend through side wall 107 and are tapped for receiving set screws. Depressions 123 in the inner wall of side 109 in opening 119 are positioned directly opposite the tapped holes 121 to permit the upstanding seam of the roof to be deformed laterally in bumps opposite the set screw to firmly anchor the snow brake to the roof.

The sides which are approximately three times as thick as the blade, in combination with the support portions 117 of the blade and vertical member 113 and the rounded stress relieving top 125, prevent separation of the side walls as set screws are torqued into the openings 121 to deform portions of the seams into the pockets 123.

While the invention has been described with reference to specific embodiments, modifications and variations of the invention can be made without departing from the scope of the invention, as described in the claims.

We claim:

1. A snow brake comprising a base with a bottom and a top, the base having a longitudinally extending body with first and second longitudinal ends, a slot extending upward from the bottom toward the top and terminating spaced from the top and extending through the first and second ends for receiving a folded seam of a metal roof in the slot, the slot dividing the base into first and second opposite sides connected at the top, one side having holes extending transversely through the side for receiving and holding anchor screws, the other side having recesses aligned with the screw-receiving holes for receiving outward bent portions of the roof seams in the recesses, a snow brake plate connected to the base and extending laterally beyond the opposite sides of the base and extending upward to beyond the top of the base and having lateral portions extending outward from the opposite sides of the base near one end of the base and near a bottom of the plate, the opposite sides of the base being relatively thick as compared to the thickness of the plate and the lateral portions of the plate being cast and constructed for providing resistance against separation of the sides when tightening anchor screws for being roof seam portions into the recesses, and for preventing bending or breaking of the snow plate.

2. The apparatus of claim 1, further comprising an upper extension extending from a portion of a top of the base to a mid-portion of the snow brake plate for strengthening the plate.

3. The apparatus of claim 1, wherein the plate has a curved bottom with support portions adjacent sides of the base.

4. The apparatus of claim 3, wherein the plate has generally curved outer edges.

5. A snow brake comprising an inverted, rectangular, U-shaped base having a central slot for receiving a folded seam of a metal roof, first and second sides extending along the slot and a curved top interconnecting the sides, the first side having fastener-receiving openings for receiving seam-engaging fasteners, and the second side having enlarged recesses for receiving deformations in seams caused by the fasteners, a snow plate extending upward at an angle from one longitudinal end of the base, the snow plate having a curved bottom portion extending laterally beyond bottoms of the sides of the base, and lower, inner sections of the plate connected to bottom portions of the first and second sides supporting the sides with the snow plate and for preventing relative outward movement of the sides when deforming the roof seams into the recesses with the fasteners.

6. The apparatus of claim 5, wherein the bas sides are relatively thick as compared with the snow plate.

7. The apparatus of claim 5, further comprising an upper extension extending upwardly from the top and engaging a central portion of the snow plate for supporting the snow plate.

8. The apparatus of claim 7, wherein the upper extension curves upward from a portion of the top near the plate to a portion of the plate above the top of the base.

9. The apparatus of claim 5, wherein a second longitudinal end of the base is rounded.

10. A snow brake comprising a base with a bottom and a top, the base having a longitudinally extending body with first and second longitudinal ends, a slot extending upward from the bottom toward the top and terminating spaced from the top and extending through the first and second ends for receiving a folded seam of a metal roof in the slot, the slot dividing the base into first and second sides connected at the top, one side having holes extending transversely through the side for receiving and holding anchor fasteners, the other side having recesses aligned with the holes for receiving outward bent portions of the roof seams in the recesses, a snow stop plate connected to the base and extending laterally beyond opposite sides of the base and extending upward to beyond the top of the base, and lateral supports extending outward from sides of the base near the bottom of the base and being connected to laterally extended portions of the snow stop plate near a bottom of the plate, the lateral supports and bottom portions of the plates which are connected to the lateral supports being constructed for providing resistance against separation of the sides when tightening anchor fasteners for bending roof seam portions into the recesses, and for preventing bending or breaking of the snow plate.

11. The apparatus of claim 10, further comprising an upper extension extending from a portion of a top of the base to a mid-portion of the snow stop plate for strengthening the plate.

12. The apparatus of claim 10, wherein the lateral supports are generally flat plates.

13. The apparatus of claim 12, wherein the lateral support flat plates have generally curved outer edge surfaces.

* * * * *